US006868806B1

(12) United States Patent
Schimmeyer

(10) Patent No.: US 6,868,806 B1
(45) Date of Patent: Mar. 22, 2005

(54) VENT DAMPER APPARATUS

(76) Inventor: Werner Schimmeyer, 8937 Acorn Pl., Santa Rosa, CA (US) 95409

( * ) Notice: Subject to any disclaimer, the term of this patent is extended or adjusted under 35 U.S.C. 154(b) by 0 days.

(21) Appl. No.: 10/629,009

(22) Filed: Jul. 28, 2003

(51) Int. Cl.[7] ..... F22B 5/00
(52) U.S. Cl. ..... 122/155.1; 122/135.1; 126/307 A; 126/285 A
(58) Field of Search ..... 122/135.1, 155.1, 122/13.01; 126/307 A, 285 A, 361.1

(56) References Cited

U.S. PATENT DOCUMENTS 4,269,166 A * 5/1981 Worley et al. ..... 126/285 R
4,372,485 A * 2/1983 McCabe ..... 236/1 G
4,509,499 A * 4/1985 Hebert ..... 126/292
4,770,160 A 9/1988 Schimmeyer
4,953,510 A * 9/1990 Akkala et al. ..... 122/13.01
5,239,947 A 8/1993 Schimmeyer
5,682,841 A 11/1997 Schimmeyer
5,732,692 A 3/1998 Schimmeyer
5,845,632 A 12/1998 Schimmeyer

* cited by examiner

*Primary Examiner*—Gregory Wilson
(74) *Attorney, Agent, or Firm*—Walter A. Hackler

(57) ABSTRACT

A vent damper apparatus provided for limiting flow of ambient air in a flue of a water heater. The apparatus generally includes a base structured to be connected to a water heater, and a damper assembly, extending from the base and structured to be responsive to a variable flow of exhaust gasses passing from a flue of the water heater. The damper assembly includes a plurality of independently movable dampers, and a frame structured to provide support to the plurality of independently movable dampers.

9 Claims, 3 Drawing Sheets

VENT DAMPER APPARATUS

The present invention generally relates to water heating apparatus and more specifically relates to vent damper apparatus for a water heater tank.

Combustion hot water heaters typically utilize oil or natural gas which is burned in a combustion chamber disposed in a base of a hot water tank. Water heating is effected through the base of the hot water tank and additionally, through a central passageway, or exhaust flue, passing through the hot water tank. Exhaust gasses from the combustion chamber are vented through the flue and eventually are passed to the outside air, for example, by means of an exhaust port disposed above the water heater tank.

Energy losses through an exhaust flue can be significant; it is estimated that approximately 33% of the heat energy generated from the main burner and pilot light operation is lost directly up the flue. In addition, an unrestricted duct allows cool room air to circulate freely through the hot water heater and its central core, thereby cooling the heated water and requiring the main burner to operate more frequently than would otherwise be necessary. Thus, it is clearly desirable, for efficiency and cost considerations, to regulate the flow of gasses both in and out of a gas-fired hot water heater.

Numerous damping devices have been developed for use with boilers, furnaces, and other combustion gas-producing systems. Many are simply one-way mechanical valves that prevent outside air from coming down the exhaust duct. While effective for that purpose, such devices often require significant exhaust flow in order to open, and thus are useable only with relatively large units, or those equipped with a fan or blower. Some large commercial water heaters may include power-assisted or computer-controlled mechanical dampers. Unfortunately, such systems are too costly and cumbersome for widespread domestic use.

Useful and effective heat conserving systems for relatively small scale water heaters, for example domestic water heaters, have been described in U.S. Pat. No. 4,770,160, U.S. Pat. No. 5,239,947, U.S. Pat. No. 5,682,841, U.S. Pat. No. 5,732,692, and U.S. Pat. No. 5,845,632 to Schimmeyer, each of which is incorporated herein by this specific reference thereto.

For example, U.S. Pat. No. 4,770,160 discloses a vent damper which is incorporated into an exhaust flue above a water heater. The damper comprises a lightweight, frustroconical shaped floating poppet what is slidably mounted on a guide within a flue hood immediately above the heater. When the heater burner is in operation, the hot exhaust gases lift the poppet allowing gas to escape around the poppet and into the flue. When the main burner is turned off, the poppet is lowered into a closed position where it rests atop the tank central passageway.

Unfortunately, while this system is effective in restricting the circulation of cool room air through the water heater, the long term operation thereof may result in impaired movement of the poppet due to condensation and debris accumulating between the poppet and the central guide, thus inhibiting the free movement of the poppet along the guide.

Additionally because of the fragile, lightweight nature of the poppet, damage may occur thereto by handling of the device during installation, cleaning or maintenance thereof.

Although the floating poppet closure provides a substantial improvement over the prior art, the shape of the poppet tends to interrupt the vertical flow of exhaust gases, and deflects the flow away from a vertical direction. It can be appreciated that it is desirable to have a vent damper apparatus that directs a flow of exhaust gasses substantially vertically rather than deflecting the gasses, thus ensuring the hot gasses are passed into the exhaust port and not into a surrounding space.

U.S. Pat. No. 5,732,692 discloses a more complicated vent damper system that incorporates a floatable damper with an exhaust flue hood disposed above a water heater tank. A lightweight floating damper is movable along a faceted guide. This design tends to reduce the occurrence of condensation which could impede free movement of the damper.

Although these systems are effective, there remains a need for an improved vent damper system that requires little, if any, cleaning or other maintenance to keep the system operational and is suitable for successful long term operation when installed as a part of a combustion water heater.

SUMMARY OF THE INVENTION

Accordingly, apparatus for limiting flow of ambient air in an exhaust port of a water heater having a hot water tank, oil or gas burner and an exhaust flue, in accordance with the present invention generally comprises a base structured to be installed on a conventional water heater, and a vent damper assembly extending from the base and structured to be responsive to a variable flow of exhaust gasses passing from the exhaust port of the water heater. The base is structured to be connected to the water heater tank immediately above and in communication with the water heater flue.

The damper assembly is designed to remain in a closed position in the absence of increased pressure within the flue and to assume an open position only as sufficient or necessary to allow venting of hot exhaust gasses from the flue.

More particularly, the damper assembly includes a plurality of independently movable dampers that preferably are assembled such that they each lean toward one another to form a substantially closed configuration under force of gravity. The dampers are easily pivoted away from one another and into an open configuration in response to an increase in pressure within the flue due to flow of exhaust gases.

Advantageously, when in the open position, the assembly allows a substantially vertical outflow of the exhaust gasses from the flue. In addition, the vent damper assembly is designed to require little if any maintenance over a long period of time.

In one specific embodiment of the invention, each of the independently movable dampers comprises a substantially planar, or flat, panel, having a base portion and a relatively narrow upper portion. For example, each damper may have an upwardly tapering, or generally triangular configuration. In a particularly advantageous embodiment of the invention, the plurality of independently movable dampers comprises about four dampers which form generally pyramidal structure when in a closed, resting position.

The independently movable dampers may be arranged in a manner such that the base portions of the dampers are adjacent one another, and each base portion is pivotably connected to the base of the apparatus. When in a closed, resting position, each damper of the damper assembly leans inwardly toward each other damper, forming a generally closed pyramidal structure.

Preferably, the vent damper assembly further includes a frame for supporting the independently movable dampers. The frame may comprise for example an upper plate, and a plurality of legs extending therefrom and connected to the base. Each of the legs is preferably angularly disposed with respect to each other of the legs, forming an upward tapering support structure.

In a particularly advantageous embodiment of the invention, the vent damper assembly is structured to limit a range of movement of the plurality of independently movable dampers. More particularly, each of the dampers may include a stop element, or tab, positioned to prevent the damper from pivoting, or rotating, past a desired position.

Advantageously, the vent damper assembly is structured to pass a flow of exhaust gasses in a substantially vertical direction, and preferably in a substantially undeflected manner. Thus, substantially all gasses will be directed into and received by the exhaust flue, with little or no gasses being vented into a surrounding area.

BRIEF DESCRIPTION OF THE DRAWINGS

The advantages and features of the invention will be better understood with reference to the following detailed description when considered in conjunction with the accompanying drawings in which.

DETAILED DESCRIPTION

Figure 1:
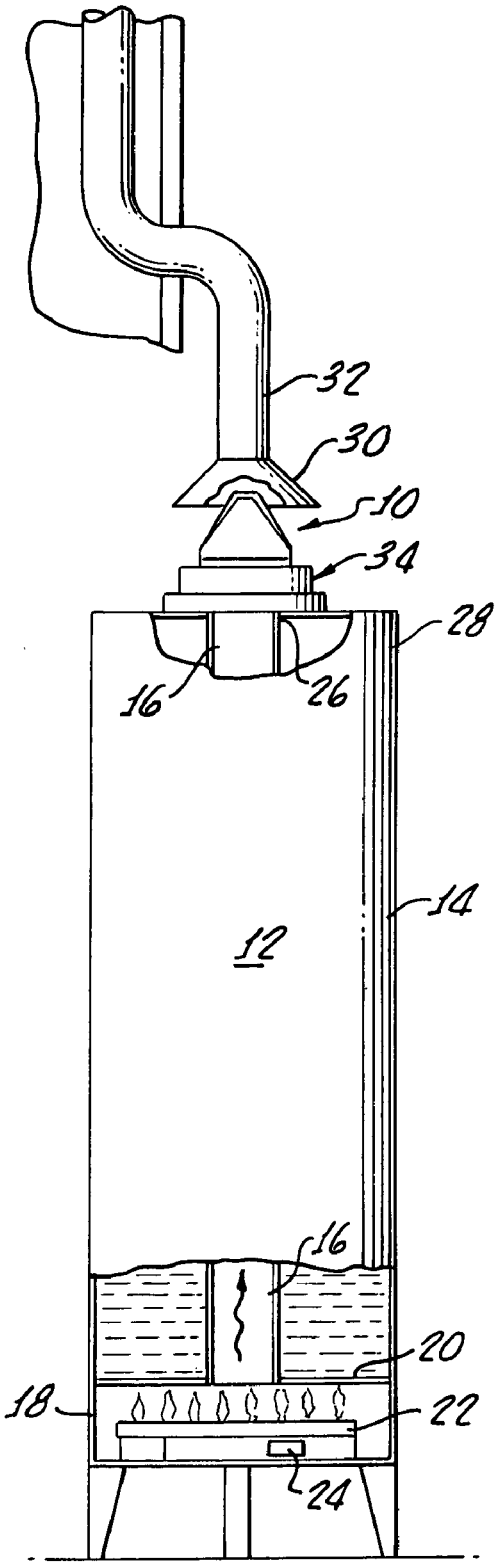
FIG. 1 is a plan view, partially broken away, of one embodiment of the present invention, generally showing a water tank with a flue therethrough, heated by a burner, and an apparatus in accordance with the present invention, the apparatus being shown connected to the water tank immediately above an outlet port of the flue.

Turning now to FIG. 1, apparatus 10 in accordance with the present invention is shown, as installed on a hot water heater 12 having a tank 14, with a flue 16 therethrough and a combustion chamber 18 disposed at a bottom 20 of the tank 14 and water heater 12, the combustion chamber 18 having a conventional burner 22 and pilot light 24 disposed therein.

The apparatus 10 is designed to stop, limit or restrict flow of ambient air into a port 26 of the flue 16 and to conserve heat therein. The apparatus 10 is structured to be connected between an upper end 28 of the water heater 12 and a hood 30 of an exhaust flue 32.

The apparatus 10 generally comprises a base 34 for connecting the apparatus 10 to the water tank 12 such that the apparatus 10 is disposed directly above the water heater flue 16 as shown.

Figure 2:
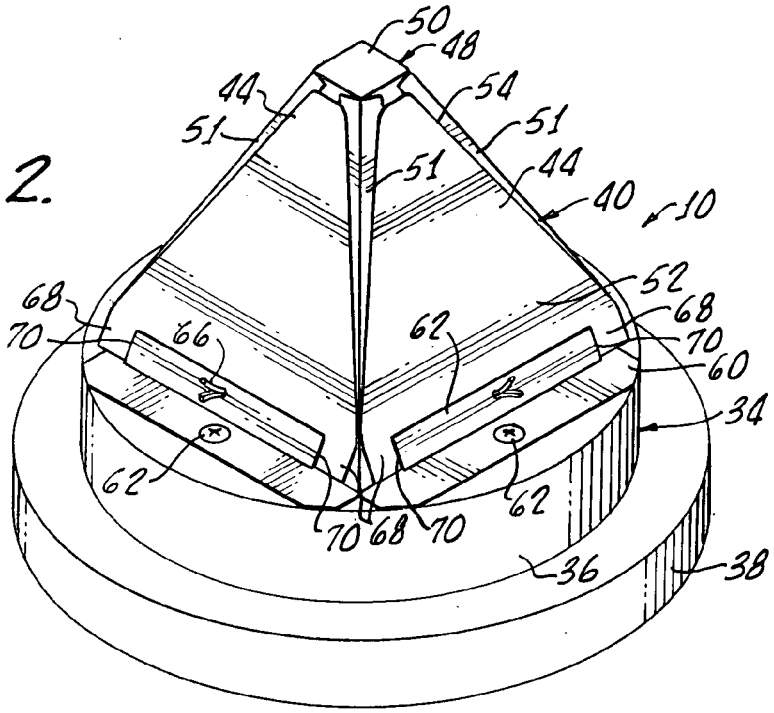
FIG. 2 is a perspective view of the apparatus of the present invention including a damper assembly in a closed position, the damper assembly including a plurality of independently movable dampers.
Figure 3:
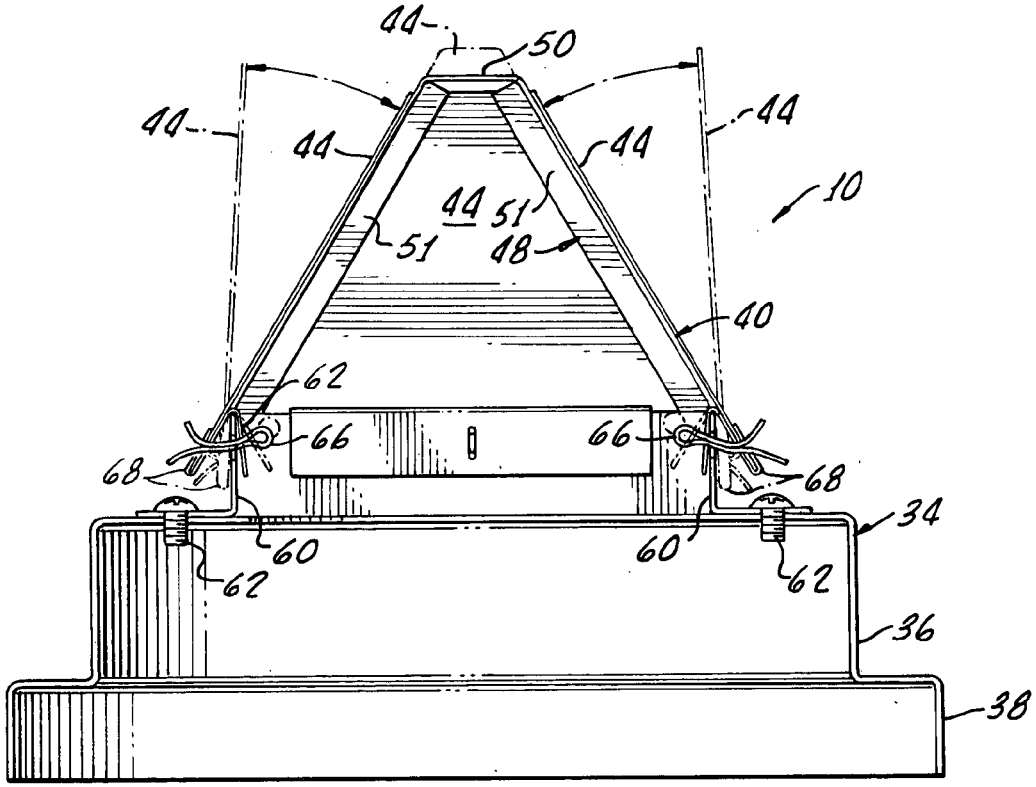
FIG. 3 is a cross-sectional view of the apparatus taken along line 3—3 of FIG. 4.

It should be appreciated that the tank 14, burner 22, and water heater flue 16 may be of any conventional, suitable design. The base 34 of the apparatus 10 may be suitably structured to facilitate installation of the apparatus 10 to the water heater 12. For example, a vent damper assembly having an adaptor base is described in Schimmeyer, U.S. Pat. No. 5,682,841, which is incorporated herein by this specific reference thereto, for providing a description of a suitable manner, with appropriate modifications thereto, for connecting the vent damper to a conventional water heater. As shown in FIGS. 2 and 3, the base 34 may include steps 36, 38 for enabling installation on flues (not shown) of two different diameters currently used in conventional water heaters.

The apparatus 10 further comprises a damper assembly 40, extending from the base 34 and structured to be responsive to a variable flow of exhaust gasses passing from the water heater flue 16 (not shown in FIGS. 2 and 3). The damper assembly 40 may comprise a plurality of independently movable dampers 44, and a frame 48 structured to provide support to the plurality of independently movable dampers 44. The frame 48 is structured to provide appropriate relative positioning and support to the independently movable dampers 44, and may for example, comprise an upper plate 50, and a plurality of angularly disposed legs 51 extending therefrom and connected to the base 34.

Referring now specifically to FIG. 3, the dampers 44 are shown (in cross section) in a closed position, resting against the frame 48, and, in phantom line, in a substantially vertical, open position. Preferably, the plurality of independently movable dampers 44 are connected to the base 34 in such a manner that, when in a closed position, the dampers 44 lean inwardly, i.e. toward one another and rest against the frame legs 51 such as shown in FIG. 2. When in an open position, the dampers 44 lean, or rotate, outwardly, i.e. generally away from one another, in response to a pressure differential generated by rising exhaust gasses in the flue 16.

Turning back now to FIG. 2, each of the independently movable dampers 44 preferably comprises a substantially planar panel made of aluminum or other suitable, preferably lightweight, material. In a particularly advantageous embodiment of the invention, the plurality of independently movable dampers comprises at least three dampers and preferably comprises four dampers 44, as shown in the Figures.

In the embodiment of the invention shown, each damper 44 has an upward tapering, generally triangular configuration, including a relatively wide base portion 52 and a relatively narrow upper portion 54.

The base portion 52 of each damper 44 may be pivotally, or rotatably, connected to an upper surface of the base 34 by a suitable connecting mechanism. For example, as shown most clearly in FIG. 3, an L-shaped bracket 60 is provided at the base portion 52 of each damper 44. The bracket 60 may be mounted to an upper surface of the base 34 as shown in FIGS. 2 and 3, for example by suitable fasteners 62.

Each damper 44 may be pivotally mounted to the L-shaped bracket 60 by means of pins 66.

In addition, means are preferably provided for limiting a range of motion of the damper 44. In the embodiment of the invention shown, tabs 66 are provided within the base portion 52 of each damper 44. The tabs 68 may be formed by cuts 70 in each damper base potion 52 and the tabs may be bent as shown in FIG. 3 to limit pivoting of the damper 44 to a substantially vertical position (see phantom line in FIG. 3) while preventing the damper 44 from pivoting beyond the vertical position. Thus, the tabs 68 are adjustable with respect to the damper 44 for controlling the limit of damper 44 movement.

Figure 4:
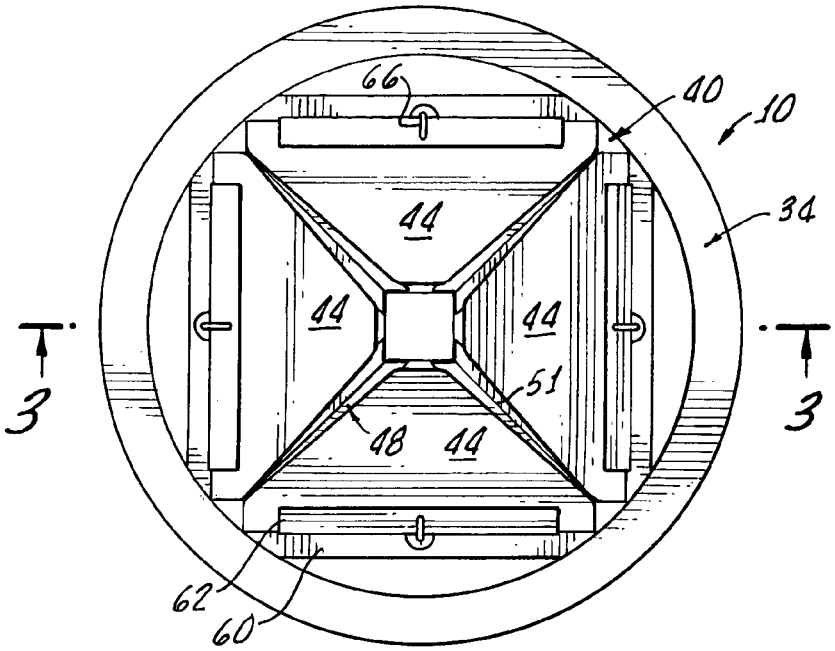
FIG. 4 is a top view of the apparatus of the invention shown in FIG. 2, showing the plurality of independently movable dampers disposed in a closed position.
Figure 5:
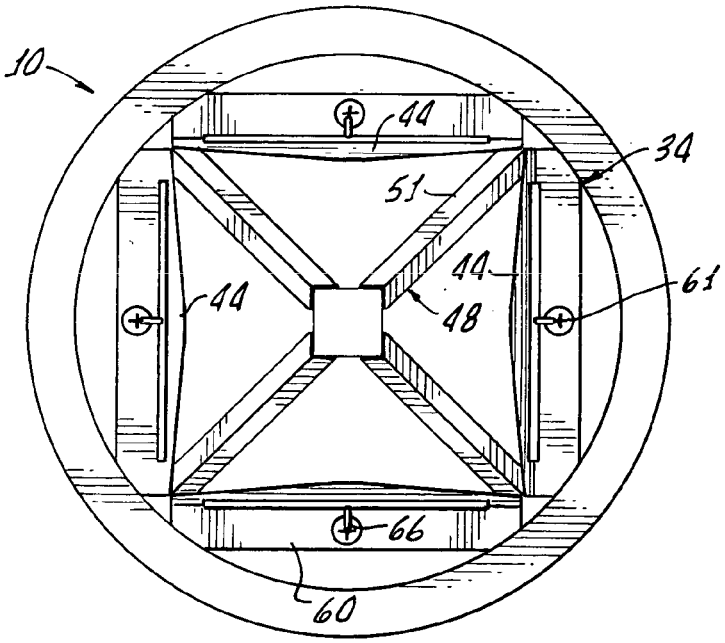
FIG. 5 is a top view of the apparatus of the invention shown in FIG. 2, similar to the view shown in FIG. 4, except that the plurality of independently movable dampers are shown disposed in an open position.

Referring now to FIGS. 4 and 5, the apparatus 10 is shown with the plurality of independently movable dampers 44 disposed in a resting, closed position in FIG. 4 and disposed in a maximum open position in FIG. 5. The damper assembly 40 is structured to be responsive to a variable flow of exhaust gasses passing from an exhaust port of the water heater.

Thus, it will be appreciated the dampers 44 rotate outwardly only as far as necessary to allow a variable flow of exhaust gasses to be passed from the flue. For example, after being forced into a maximum open position, the dampers 44 will naturally drop toward the closed position as the force of the gasses decreases, without completely closing the passageway, until the pressure stabilizes. The tabs 68 also function to insure that gravity functions to close the dampers 44 by setting a maximum open angle of the damper when opened.

The apparatus 10 in accordance with the present invention is structured to pass a flow of exhaust gasses in a substantially vertical direction, and more preferably in a substantially vertical, substantially undeflected direction. This design ensures that substantially all exhaust gasses leaving the water heater flue are passed directly into the flue hood and not into the surrounding structure.

The apparatus of the present invention is structured to require little if any maintenance. For example, the sloped positioning, and preferably planar nature of the dampers 44 tends to reduce the amount of condensation, dust and/or debris that might otherwise accumulate on the apparatus 10. Each time the dampers 44 rotate toward the open position, condensation and debris is shed therefrom.

In addition, in the event that one or more of the dampers 44 were to malfunction, the remaining dampers remain operational and the functional integrity of the apparatus will not be compromised.

Although there has been hereinabove described a specific vent damper apparatus in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. Vent damper apparatus for a water heater, the apparatus comprising:

a base; and a damper assembly, extending from the base, for limiting flow of ambient air from a flue of the water heater, the damper assembly including a plurality of independently pivoted flat dampers, the plurality of independently movable dampers leaning inwardly toward one another when the dampers are in a closed position a frame for supporting the dampers and enabling pivoting of the dampers from the closed position preventing ambient air flow therepast to an open position allowing passages of exhaust gases therepast, said dampers being disposed generally parallel to exhaust gas flow in said open position.

2. The apparatus according to claim 1 wherein the plurality of independently movable dampers lean outwardly away from one another when the dampers are in an open position.

3. The apparatus according to claim 1 wherein the independently movable dampers are pivotally connected to the frame.

4. The apparatus according to claim 3 wherein the damper assembly includes pins for pivotably connecting the damper to said frame.

5. The apparatus according to claim 1 wherein each damper includes a tab for limiting movement of each damper past the open position.

6. The apparatus according to claim 5 wherein said tab is adjustable with respect to the damper for controlling the limit of damper movement.

7. The apparatus according to claim 1 wherein each of the plurality of independently movable dampers comprise a base portion and a relatively narrow upper portion.

8. The apparatus according to claim 1 wherein the independently movable dampers define a generally pyramidal configuration when the dampers are disposed in a closed position.

9. The apparatus according to claim 8 wherein the frame comprises a plurality of legs angularly disposed with respect to each other.

* * * * *